US005244187A

United States Patent [19]

Manginelli

[11] Patent Number: 5,244,187

[45] Date of Patent: Sep. 14, 1993

[54] MOLTEN METAL FEED SYSTEM AND METHOD FOR INVESTMENT CASTINGS

[76] Inventor: Ralph Manginelli, 6 Clover St., West Haven, Conn. 06516

[21] Appl. No.: 833,942

[22] Filed: Feb. 10, 1992

[51] Int. Cl.[5] ..... B22D 35/04

[52] U.S. Cl. ..... 266/236; 164/362

[58] Field of Search ..... 164/362, 356; 266/236, 266/287

[56] References Cited

FOREIGN PATENT DOCUMENTS 0737105 5/1980 U.S.S.R. ..... 164/362

*Primary Examiner*—Scott Kastler

*Attorney, Agent, or Firm*—Melvin I. Stoltz

[57] ABSTRACT

By providing a separate, independent, elongated, open-ended hollow conduit and positioning the conduit in the central sprue of an investment casting shell or mold, a unique dual chamber, bottom feeding system is obtained. In order to assure that the molten metal is fed to the bottom of the central sprue at the desired position, portal zones are formed near the distal end of the conduit and the molten metal is fed into the proximal end of the conduit. In the preferred embodiment, holding and locking means are employed to maintain the conduit in the desired position during the pouring process. In addition, the present invention also preferably employs a unique annular trap zone formed in the base of the central sprue in cooperating relationship, with the elongated conduit for receiving and holding impurities contained within the molten metal.

18 Claims, 3 Drawing Sheets

FIG. 5
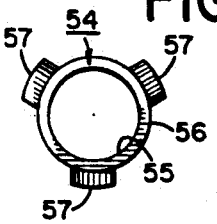
FIG. 6
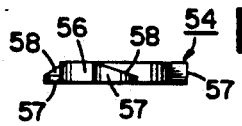
FIG. 4
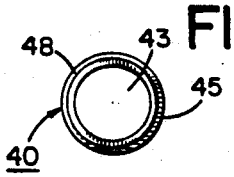
FIG. 3
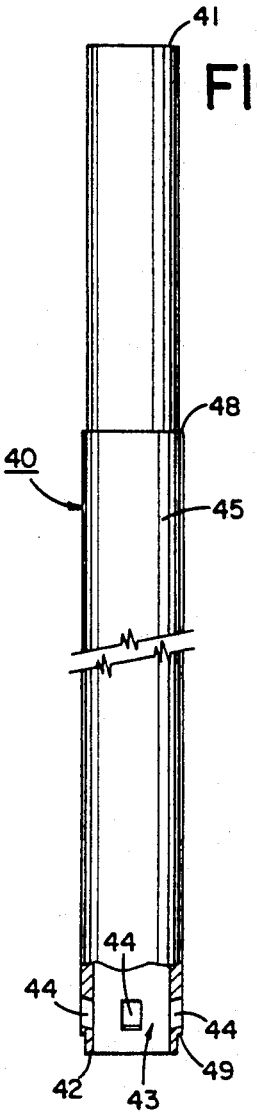
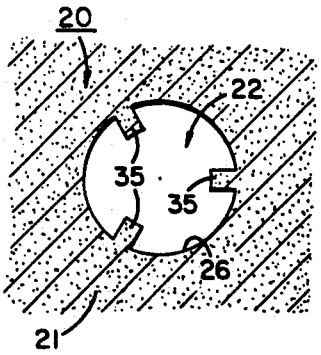
FIG. 2
FIG. 1
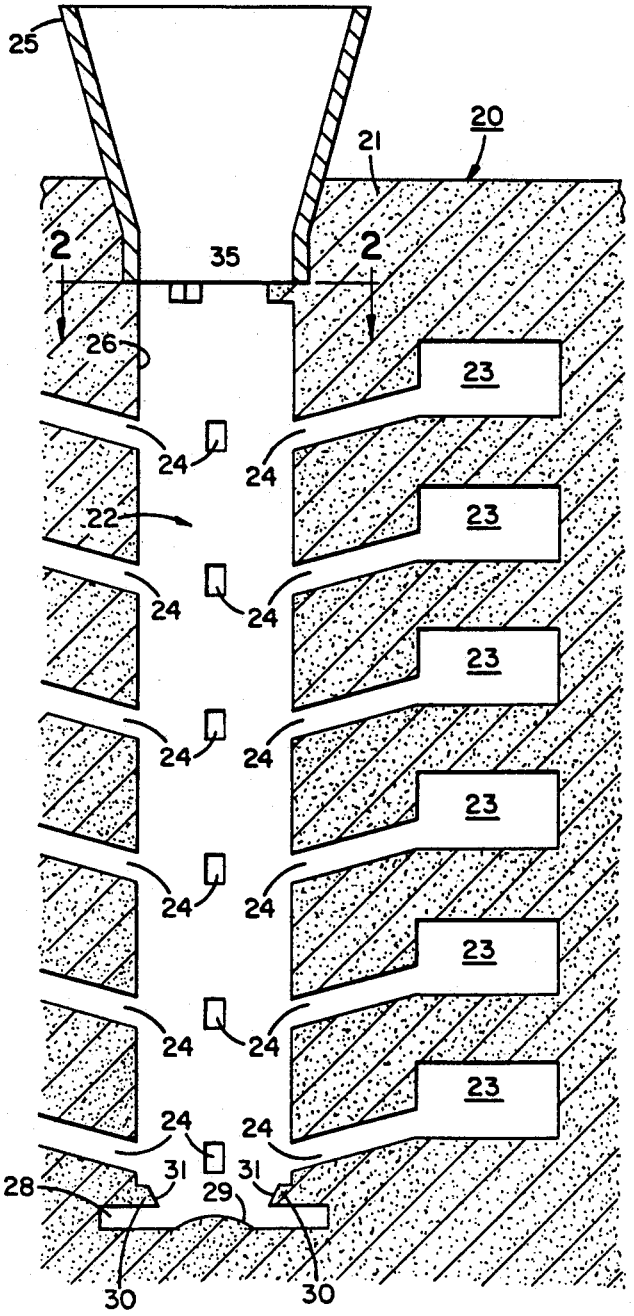

FIG. 7
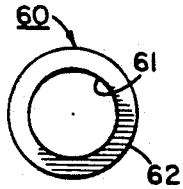
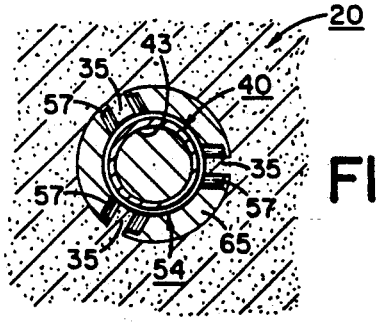
FIG. 10
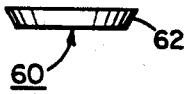
FIG. 8
FIG. 9
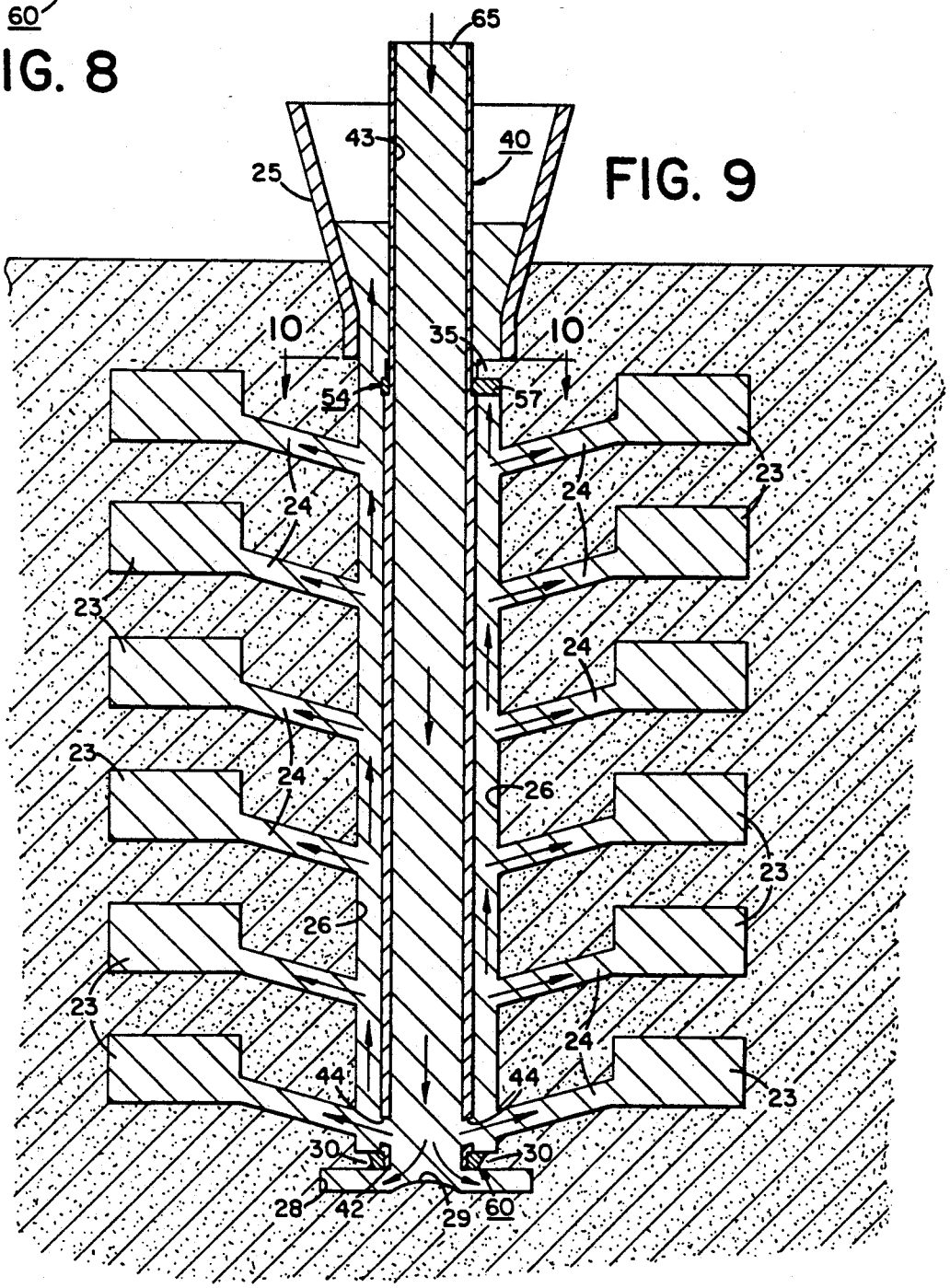

MOLTEN METAL FEED SYSTEM AND METHOD FOR INVESTMENT CASTINGS

TECHNICAL FIELD

This invention relates to molds for the casting of metal and, more particularly, to investment casting molds and methods for improving the feeding of the molten metal into the mold.

BACKGROUND ART

The formation of metal components in various desired sizes and shapes using molds is an extensively developed art in which numerous prior art techniques, methods, and mold constructions have been developed. Within this prior art technology is the extensive effort that has been expended in the field of investment casting wherein molds are formed to the precise size and shape of the desired component and then sacrificed after formation of the product therein.

Throughout the years, investment castings have been used extensively due to the unlimited flexibility of the overall casting design. In particular, investment casting has become extremely popular for complicated components which would otherwise require numerous operations to manufacture or numerous separate components to achieve. In addition, metals or alloys can be employed in investment casting which are otherwise incapable of being effectively manufactured. Furthermore, extremely tight tolerances can be maintained and improved physical properties realized from the resulting metal component.

In general, two basic techniques are employed in producing cast products using the investment casting process. These two methods are known as the investment flask casting process and the investment shell casting process. In either process, a mold is made for the component to be manufactured with this mold being constructed with great precision and close tolerances. However, since this mold is employed only for making wax or plastic components, a soft metal, such as aluminum, is typically used, thereby enabling a precision mold to be manufactured at a reasonable cost. Then, using this mold, a plurality of the wax or plastic components are manufactured.

In the next step, the plurality of wax or plastic components are mounted to a central sprue or a plurality of sprue-forming members by elongated wax or plastic members, such as rods or tubes, which form the gates or runners through which the metal will flow to reach the component casting. The pattern resulting from this operation depends upon the size and shape of the components being manufactured, as well as the flow pattern for the molten metal.

Once the pattern has been established, the actual investment casting is manufactured in either the flask casting technique or the shell casting technique. Both of these techniques are well known in the art and have been successfully employed for many years. Regardless of which technique is used, the mold or shell created possesses a central sprue or a plurality of sprues, into which the molten metal is poured, for being delivered to the gates or runners which carry the metal to the casting or void zone, which have been created in the precise size and shape of the desired product.

More recently, investment casting shells have been manufactured using computer technology. In this system, an investment casting shell is produced, layer by layer, at the micron level. However, regardless of the method of production employed, the resulting casting is substantially identical and suffer from the same drawbacks.

One of the problems encountered occurs in the actual forming of the components by pouring the molten metal into the feed mechanism of the investment casting. Typically, gravity feed is most commonly used, however, if desired, the investment casting may be filled with the molten metal employing pressure, vacuum, or centrifugal force. Since the use of pressure, reduced pressure, vacuum, or centrifugal force requires a more complicated and expensive manufacturing operation, investment casting is most often filled by employing gravity feed. Although this operation has proven to be extremely effective in providing high quality components, several drawbacks do exist and have been incapable of being eliminated.

One of the principal drawbacks is slag or oxides which are formed in the molten metal and are present on the surface of the molten metal as the metal is being poured into the investment casting. Since these impurities are usually found on the top surface of the molten metal, these impurities are the first to enter the investment casting as the molten metal is poured into the casting. Although filters have been used, these filters are unable to completely eliminate these impurities, while also controlling the flow under head pressure required. As a result, these impurities are retained in the metal flow and are often trapped in some of the components produced, thereby degrading the quality of those components.

In addition, as the molten metal is poured into the feeding mechanism of the investment casting, a turbulent flow is created, causing air to be retained in the metal flow and be incorporated into the metal. The air remains with the metal as it flows through the investment casting, creating flaws in the components produced. This turbulence problem is of particular concern in all metals in general and in skin forming alloys, in particular, which are sensitive to turbulence.

Another problem often encountered with investment castings is the control of the flow to assure complete filling of the entire casting in a manner which will produce uniformly dense, structurally sound components. Although the casting is designed with metal flow as one of the controlling factors, accurately predicting the metal flow throughout the mold is difficult and often not achieved.

Prior art attempts have been made to overcome some of the drawbacks discussed above. In this regard, it has been found that by feeding the investment casting from the bottom, instead of from the top as most usually done, a more uniform flow pattern is achieved and some of the difficulties encountered with top feeding are eliminated. However, in order to achieve bottom feeding, a secondary feed column or sprue must be formed which is connected to the base of the central sprue. Although this is effective in providing bottom feeding to the casting, substantially more molten metal is required, which substantially increases the cost of manufacturing. In addition, with components wherein the metal employed is extremely expensive, the bottom feeding technique might not be employed due to the added expense for the expended material.

Therefore it is a principal object of the present invention to provide a feed system and method of use for investment castings which provides the benefits of bottom feeding while also reducing the amount of material needed to fill the casting.

Another object of the present invention is to provide a feed system and method of use for investment castings having the characteristic features described above which is easily employed without altering the methods used for creating the investment casting or altering the metal filling process used therewith.

Another object of the present invention is to provide a feed system and method of use for employing investment castings having the characteristic features described above which is capable of eliminating the incorporation of any trap slag or oxides in the components being manufactured.

A further object of the present invention is to provide a feed system and method of use for investment castings having the characteristic features described above which eliminates turbulent flow, thereby eliminating air entrapment within the molten metal and resultant components.

Another object of the present invention is to provide a feed system and method of use for investment castings having the characteristic features described above which assures complete filling of the entire casting while also producing a higher quality product.

Other and more specific objects will in part be obvious and will in part appear hereinafter.

SUMMARY OF THE INVENTION

By employing the present invention, all of the difficulties, drawbacks, and inherent problems found in the prior art have been improved or eliminated. Instead, a highly effective, efficient, and easily employed feed system and production method is provided, without requiring any substantive change in the construction of the investment casting or in the feeding of the molten metal into the casting.

In the present invention, the prior art casting manufacturing techniques presently being used are employed, whether it be flask casting, shell casting, or computer-aided casting. If desired, the prior art casting structure can be used without any change. However, in using the teaching of this invention, a separate, independent elongated, open-ended, hollow tube is constructed and inserted coaxially in the sprue of the casting, establishing a dual chamber, molten metal flow controlling structure, with the two chambers being coaxially aligned with each other. Furthermore, in the preferred embodiment, the casting is constructed for providing cooperating, secure interengagement of the elongated tube therewith.

In the preferred construction, the elongated hollow tube of this invention incorporates portal zones formed through the wall of the tube, directly adjacent the bottom distal end thereof. In use, the tube is mounted in the sprue of the casting, with the distal end spaced above the bottom of the sprue floor. In this way, the elongated tube forms a centrally disposed, molten metal flow channeling zone for delivering the molten metal directly to the bottom of the sprue. As a result, the molten metal is poured into the proximal end of the elongated hollow tube, passes through the tube, and is able to flow out of the distal end and the portals of the tube into the sprue zone.

Once the molten metal passes through the portals of the elongated tube, the molten metal enters the upsprue zone and moves upwardly through the up sprue zone which peripherally surrounds the tube member. In this way, bottom feeding is achieved, without requiring a separate elongated feed sprue and horizontally disposed connecting passageway.

As with the prior art systems, the feed mechanism is always pressurized by the height of the column of molten metal, which is always maintained full throughout the pour cycle, with molten metal being supplied only from the top. In the present invention, the flow rate to the sprue zone is easily controlled by the size and shape of the portals or passageways formed at the base of the elongated tube member. By properly designing and positioning the portals, the molten metal is efficiently and smoothly delivered to the sprue zone for distribution to the entire casting. As a result, precise flow rates are obtained and turbulence is virtually eliminated. Consequently, entrapment of air is avoided and the components formed are substantially improved and structurally enhanced.

In the preferred embodiment, the central tube is constructed for being locked into position prior to use. In this way, assurance is provided that the tube is securely mounted in the sprue zone and is incapable of being dislodged by the addition of the molten metal. If desired, the tube may be constructed in a manner which enables the tube to be removed for added feed metal for riser demand if needed.

In addition to providing a convenient, easily employed delivery system for achieving the bottom feeding of molten metal, the casting employed in the present invention also preferably incorporates an enlarged annular-shaped trap zone formed at the base of the sprue zone, communicating directly with the open distal end of the tube member. In this way, the initial pouring of the molten metal passes through the tube and is delivered to the annular trap zone prior to being delivered through the portals to the central sprue. As a result, the trap slag and oxides forming the initial metal flow are delivered to the annular zone and retained in this zone, preventing these impurities from reaching the component-forming cavities of the casting, thereby preventing the product from being contaminated.

Another advantage obtained with the central feeding tube construction of the present invention is the ability to substantially reduce the amount of molten metal needed to feed and cast shells and molds producing the same quantity of castings. By employing the present invention, and controlling the wall thickness of the central tube, a substantial quantity of metal can be eliminated from the volume required to fill prior art central sprues. As a result, this material is not required and a substantial savings is realized by the customer.

In all occasions, the down feed tube displaces enough metal to warrant its use. In very large applications, the down feed tube can be hollow dual wall for maximum metal saving, leaving a wall thickness in the upsprue adequate to feed attached castings. Large diameter upsprues may be necessary to increase the amount of pieces per shell, thus creating higher yield and financial gain in addition to metal savings and controlled metal flow. The savings obtained by employing the present invention are of particular importance in all applications, and are of particular benefit with inherently expensive metal having a high cost per pound.

The invention accordingly comprises the several steps and the relation of one of one or more such steps with respect to each of the other and the apparatus embodying the features of construction, combinations of elements and arrangement of parts which are adapted to effect such steps, all as exemplified in the following detailed disclosure, with the scope of the invention being indicated in the claims.

BRIEF DESCRIPTION OF THE DRAWINGS

For a fuller understanding of the nature and objects of the invention, reference should be had to the following detailed description taken in connection with the accompanying drawings, in which:

FIG. 1 is a cross-sectional, side elevation view, partially broken away, showing an investment casting mold or shell constructed in accordance with the present invention;

FIG. 2 is a top plan view of the investment casting mold or shell of FIG. 1, taken along line 2—2 of FIG. 1;

FIG. 3 is a side elevation view, partially broken away, and partially in cross-section of a central elongated metal delivery tube of the present invention;

FIG. 4 is a top plan view of the delivery tube of FIG. 3;

FIG. 5 is a top plan view of a locking ring employed in association with the delivery tube;

FIG. 6 is a side elevation view of the locking ring of FIG. 5;

FIG. 7 is a plan view of a support ring employed in association with the delivery tube;

FIG. 8 is a side elevation view of the support ring of FIG. 7;

FIG. 9 is a cross-sectional, side elevation view, partially broken away, of the fully assembled investment casting mold or shell and elongated delivery tube of this invention, depicted in cooperating interengagement with each other when in use;

FIG. 10 is a cross-sectional plan view of the assembly of FIG. 9 taken along line 9—9 of FIG. 8;

DETAILED DESCRIPTION

Figure 11:
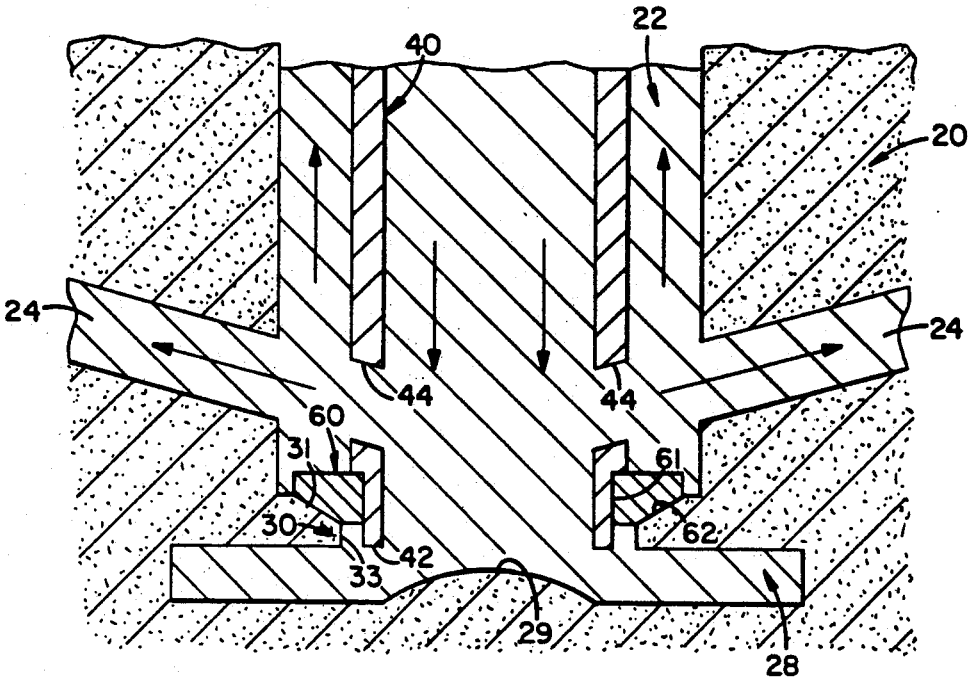
FIG. 11 is a cross-sectional side elevation view, partially broken away, of an alternate embodiment of a fully assembled investment casting mold or shell and elongated delivery tube of this invention in cooperating interengagement with each other when in use.

In FIG. 1, an investment casting mold or shell 20 is shown as manufactured in accordance with the present invention. As is commonly employed in the investment flask casting procedures, the investment shell casting procedures, and the computer generated casting procedures, discussed above, mold or shell 20 is constructed from conventional mold material 21, which is easily broken away from the metal formed components at the end of the molding operation.

As is apparent to one of ordinary skill in the art, FIG. 1 depicts a representative casting for purposes of discussion and explanation. However, the actual construction and configuration of mold or shell 20 is controlled by the particular components being formed and the size and shape thereof. In addition, as is well-known in the art, a plurality of secondary sprues may peripherally surround the central sprue and be interconnected therewith, with a plurality of components forming cavities extending from each secondary sprue, thereby substantially increasing the number of components being made from the mold or shell.

Depending upon the components being formed, and the metal requirements thereof, the number of components capable of being manufactured in a single mold or shell determined, taking into consideration the flow rate capabilities of the metal. However, all of these factors are known in the prior art. Consequently, mold or shell 20 is merely representative of a conventional casting construction incorporating the details of the present invention, as defined herein. Furthermore, the scope of the present invention is not intended to be limited to any particular configuration, but is clearly intended to encompass all casting constructions incorporating the feeding system of this invention.

In FIG. 1, mold or shell 20 is depicted with a central sprue 22 and cavity zones 23, each of which represents the component to be formed. Furthermore, in order to fill cavity zones 23 and form the desired component to the precisely desired size and shape, each cavity zone 23 is connected to central sprue 22 by a molten metal delivery channel or gate 24. Finally, as commonly employed in prior art constructions, mold or shell 20 also incorporates an enlarged metal receiving pouring cup 25.

As shown in FIG. 1, central sprue 22 forms a metal delivery passageway which is defined by cylindrically-shaped wall 26. In order to assure that the molten metal flows from central sprue 22 to each of the cavity zones 23, gates 24 are formed in wall 26 of sprue 22 to enable the metal to freely flow to cavity zones 23.

In providing mold or shell 20 with one of the unique aspects of the present invention, mold or shell 20 is constructed with an annular-shaped open zone 28 formed at the base of central sprue 22. In addition, a raised boss or convexly shaped dome portion 29 is formed at the bottom of central sprue 22, disposed substantially centrally on the bottom surface of sprue 22 and enlarged annular zone 28.

As is more fully detailed below, enlarged annular zone 28 establishes an impurity capture zone within which all of the initially poured oxides and trap slag of the molten metal are retained, preventing any transferral of these impurities to the components being formed. In order to assure that the entire annual zone 28 is filled, convexly shaped dome portion 29 is positioned at the bottom of central sprue 22 forcing the molten metal outwardly into annular zone 28 for being captured therein.

In the preferred embodiment, as depicted in FIG. 1, mold or shell 20 also incorporates a flange 30 radially extending inwardly from wall 26 of central sprue 22. Preferably, radially extending flange 30 is positioned above annular zone 28 in close proximity thereto. In addition, flange 30 also incorporates an angularly sloping terminating end surface 31. As detailed below, flange 30 is constructed for mating, cooperating, secure interengagement with a tube supporting ring in order to assure that the delivery tube of the present invention is securely positioned and properly located in sprue 22 of mold or shell 20.

The construction of mold or shell 20 of this invention is completed by incorporating therewith a plurality of radially extending posts 35, which are integrally formed as a part of wall 26 of central sprue 22. As best seen in FIG. 2, posts 35 are preferably located adjacent to bottom edge of pouring cup 25, radially extending inwardly, for a short distance, from wall 26, towards the axis of central sprue 22. In addition, as depicted in FIG.

2, three posts 35 are preferably employed, with each being positioned in a substantially equal angular distance relative to each other.

By referring to FIGS. 3 and 4, along with the following detailed description, the construction of elongated metal delivery tube 40 can best be understood. In the preferred embodiment, delivery tube 40 comprises an elongated, continuous, substantially cylindrically shaped, hollow tube member which is open at its proximal end 41, as well as at its distal end 42. Preferably, the inside diameter of tube 40 is substantially uniform throughout its entire length, forming a continuous, elongated, internal molten metal flow channeling zone 43 extending between opposed ends 41 and 42. Similarly, outside surface 45 of tube 40 also comprises a substantially smooth, continuous cylindrical shape.

In addition, elongated delivery tube 40 also incorporates a plurality of portals 44 formed in tube 40 adjacent distal end 42. Portals 44 extend through the entire thickness of elongated tube 40, thereby enabling the molten metal flowing through internal flow channeling zone 43 to exit from inside tube 40 through portals 44 to outside surface 45 of tube 40, when distal end 42 is closed.

In the preferred embodiment, as depicted in FIG. 3, elongated delivery tube 40 also incorporates a first ledge 48 and a second independent ledge 49. Both ledges 48 and 49 are formed radially extending from outer surface 45 of elongated tube 40 forming two, holding surfaces for cooperating engagement with separate locking and positioning rings.

In the preferred embodiment, ledge 49 is formed adjacent distal end 42 of tube 40 preferably spaced between distal end 42 and portals 44. As is more fully detailed below, ledge 48 is formed along outer surface 45 of elongated tube 40 at a position below proximal end 41 of tube 40, in a location for cooperation with radially extending posts 35 of mold or shell 20.

In FIGS. 5 and 6, the preferred construction for locking ring 54 is shown. In this preferred construction, locking ring 54 incorporates a substantially hollow cylindrical shape having an inside, circular shaped wall portion 55, and an outside, circular shaped wall portion 56. In addition, radially extending locking arms 57 extend from outside wall portion 56 at substantially equidistant spaced locations, peripherally surrounding wall portion 56. As best seen in FIG. 6, each radially extending locking arm 57 comprises a ramped, sloping surface 58 forming the top surface of each radially extending locking arm 57. As is fully detailed below, locking arms 57 are constructed and positioned for cooperating engagement with post 35 of mold or shell 20.

In the preferred embodiment, locking ring 54 is constructed with inside wall portion 55 having a circular shape, the diameter of which is slightly greater than the diameter of the outer wall of section 45 of tube 40, between ledge 48 and proximal end 41. In this way, locking ring 54 is capable of cooperative sliding telescopic engagement with tube 40, by easily sliding along the proximal length thereof until coming into abutting, stopping contact with radially extending ledge 48. In this way, the precisely desired position and location for securely locating locking ring 54 along the length of elongated tube 40 is established.

As is apparent to one of ordinary skill in the art, elongated tube 40 as well as locking ring 54 may comprise any desired configuration or shape. However, as depicted in FIG. 3-6, cylindrical shapes are preferred, as providing the most efficient and cost effective construction. However, alternate shapes can be used without departing from the scope of this invention.

As is more fully detailed below, prior to inserting tube 40 into mold or shell 20, locking ring 54 is telescopically mounted on tube 40, with locking ring 54 advancing along surface 45 of tube 40, until locking ring 54 is brought into abutting stopping contacting engagement with ledge 48. As will be more fully detailed below, when ring 54 is engaged on ledge 48, radially extending locking arms 57 are positioned in the precisely desired location for being brought into abutting, secure, locked interengagement with radially extending posts 35 of mold or shell 20.

In FIGS. 7 and 8, tube positioning and supporting ring 60 is clearly shown. In this preferred embodiment, ring 60 comprises a substantially annular toroidal shape, defined by an inner wall portion 61 and an outer wall portion 62. Inner wall 61 comprises a size and shape which enables ring 60 to be positioned in cooperating association with distal end 42 of elongated tube 40, for providing abutting, contacting, holding engagement with ledge 49 thereof.

In the preferred embodiment, inside wall portion 61 of support ring 60 comprises a substantially circular shape having a diameter straight or tapered to accommodate the slightly greater straight or tapered diameter of outer surface 45 of tube 40 between distal end 42 and ledge 49. In this way, ring 60 is quickly and easily slipped over the distal end 42 of elongated tube 40 and brought into abutting, contacting engagement with ledge 49, thereby securely positioning and effectively lockingly maintaining ring 60 in this abutting engaged position.

Outside wall portion 62 of ring 60 preferably comprises a slanted or sloping wall configuration, the angle of which is constructed for cooperating, mating, abutting contacting interengagement with slanted wall 31 of radially extending flange 30 of mold or shell 20. As clearly shown in FIG. 9, when elongated metal delivery tube 40 is telescopically positioned in central sprue 22 of mold or shell 20, ring 60 is brought into abutting, contacting interengagement with sloped wall 31 of flange 30 of mold or shell 20, thereby assuring that distal end 42 of tube 40 is in the precisely desired securely located position.

In the preferred construction, radially extending flange or ledge 49 of elongated tube 40 is spaced away from distal end 42, a distance which assures that distal end 42 of tube 40 is maintained above convexly shaped, dome portion 29 of mold or shell 20. This assurance is provided by ring 60 and the distance between distal end 42 and ledge 49. These components cooperate to precisely establish the position of distal end 42 in mold or shell 20 when ring 60 is mounted in position about tube 40 and inserted into mold or shell 20, as shown in FIG. 9.

In FIG. 11, an alternate construction for the present invention is shown in detail. In this construction, radially extending flange 30 of mold or shell 20 incorporates an angular sloping terminating end surface 31 as forming a portion of the inside surface of flange 30, with substantially flat, annular, ridge-defining portion 33 extending from the terminating edge of sloping portion 31 and forming the remainder of the inside surface of flange 30.

In this way, as clearly shown in FIG. 11, the cooperating, sloping surface 62 of tube supporting and positioning ring 60 is maintained at an increased distance from annular zone 28, with annular, ridge defining portion 33 forming an annular-shaped recess with the terminating end 42 of delivery tube 40. It has been found that in this construction, the initial poured oxides and trapped slag of the molten metal are efficiently retained and the present invention is further enhanced.

In addition, as depicted in FIG. 11, distal end 42 of metal delivery tube 40 comprises a tapered or sloping outer surface which is constructed for cooperating with a tapered or sloping inside surface 61 of ring 60. By employing this tapered or sloped construction, the desired nested interengagement and precise positioning of tube 40 in ring 60 is assured and distal end 42 of tube 40 is maintained in the precisely desired location. In this way, a construction is provided which assures that distal end 42 of metal delivery tube 40 is securely positioned in the precisely desired location for cooperating with trap zone forming surface 33 of flange 30, for establishing the desired enhanced impurity capture zone.

By employing the present invention, a construction is provided wherein elongated delivery tube 40 is securely mounted in mold or shell 20 with the distal end of tube 40 supportingly maintained above the bottom surface of sprue 22, with portals 44 of tube 40 positioned in the precisely desired location. With the open distal end 42 of tube 40 spaced above the base surface of central sprue 22, the initial pour of the molten metal must pass through the open distal end 42, thereby assuring that the impurities are captured in annular zone 28.

As clearly shown in FIGS. 9 and 10, once distal end 42 of delivery tube 40 is securely positioned in sprue 22, with tube supporting and positioning ring 60 mounted about elongated tube 40 and placed in abutting, contacting, interengagement with radially extending flange 30 of mold or shell 20, elongated, molten metal delivery tube 40 is securely locked in the precisely desired coaxially aligned position within sprue 22 of mold or shell 20 by employing locking ring 54. Elongated tube 40 is securely affixed in this precisely desired position by rotating locking ring 54, bringing radially extended locking arms 57 of ring 54 into locking interengagement with radially extending posts 35 of mold or shell 20.

As detailed above, locking arms 57 incorporate ramped, slanted surfaces 58 which are positioned directly adjacent post 35 when tube 40 is mounted in mold or shell 20. By rotating locking ring 54, slanted surfaces 58 are brought into sliding contact with posts 35. Preferably, ring 54 is manually rotated, if possible, or by employing a tool (not shown) which engages arms 57 of ring 54 and enables ring 54 to be rotated. During rotation of ring 54, surfaces 58 of each radially extending arm 57 are brought into increasing frictional interengagement with posts 35, until securely locked in engagement therewith. Once in this position, elongated molten metal delivery tube 40 is securely mounted in the desired position within sprue 22, assuring that axial movement of tube 40 relative to sprue 22 during the pouring process will not occur.

Once elongated delivery tube 40 has been securely positioned in the precisely desired locked location, as shown in FIG. 9, a coaxial molten metal flow channeling delivery tube is achieved which assures that the molten metal poured into proximal end 41 thereof is retained in and flows through tube 40 until exiting therefrom through portals 44 or distal end 42. In this way, bottom feeding of shell or mold 20 is achieved efficiently and effectively, while also reducing the amount of metal needed and assuring controlled flow of the molten metal into shell or mold 20. For purposes of clarity in FIG. 9, the directional flow of molten metal 65 is depicted by a plurality of directional arrows.

As shown in FIG. 9, molten metal 65 is introduced into proximal end 41 of elongated molten metal delivery tube 40 enabling metal 65 to flow through internal metal flow channeling zone 43 of tube 40, until exiting at distal end 42. In view of the inherent nature of the molten metal to exit through the path of least resistance, the initial metal poured into elongated tube 40 will exit through open distal end 42 prior to exiting through side portals 44. As a result, the trapped slag and oxides typically found in the initial pouring of molten metal 65 exits through portal 42 and into annular cavity 28 of mold or shell 20.

By providing a raised dome portion 29 directly below open distal end 42, the metal flowing therefrom is forced into annular cavity 28, assuring the filling thereof. By constructing cavity 28 of a size and shape sufficient to receive and hold the trapped slag and oxides, molten metal 65 exiting through side portals 44 of elongated tube 40 occurs only after annular cavity 28 has been filled and the impurities securely retained therein, thereby preventing the incorporation of these impurities into the components. Furthermore, in order to be certain that the desired metal flow is obtained, elongated tube 40 is entirely filled with molten metal, and continuously replenished with additional molten metal to keep tube 40 filled.

During the pouring process, once the annular recess zone 28 has been filled with metal 65 and its impurities, molten metal 65 begins to exit through portals 44 of elongated tube 40, causing the molten metal to enter into open sprue zone 22 which is coaxially aligned and peripherally surrounding tube 40. As depicted in FIG. 9, molten metal 65 flows both upwardly filling sprue zone 22, while also entering the plurality of gates 24, delivering molten metal 65 to component forming cavities 23.

By forming portals 44 in elongated tube 40 with a particular size, shape and quantity, a flow rate is attained which completely fills each and every component forming cavity 23, while also establishing a nonturbulent, laminar flow, thereby preventing any air from becoming trapped within molten metal 65. As a result, the components formed comprise substantially increased structural integrity with reduced impurities and flaws.

It has been found that by employing the present invention, steady upward metal flow is realized due to the pressure exerted by the flow of the molten metal through elongated tube 40. In addition, by effectively forming sprue 22 into a peripherally surrounding annular zone coaxially arranged with elongated tube 40, a dual pressure head is realized, which is easily controlled and assures complete filling of all cavities 23 in a consistent, uniform manner, without incurring any turbulence during the flow distribution of the molten metal.

Furthermore, by controlling the thickness of elongated tube 40, the volume of both flow channeling zone 43 of tube 40 and annular sprue zone 22 are completely within the design parameters which are manufactured into the creation of shell or mold 20. In this way, only the required amount of metal is employed and any unnecessary metal can be effectively eliminated by increasing the wall thickness of tube 40.

Figure 12:
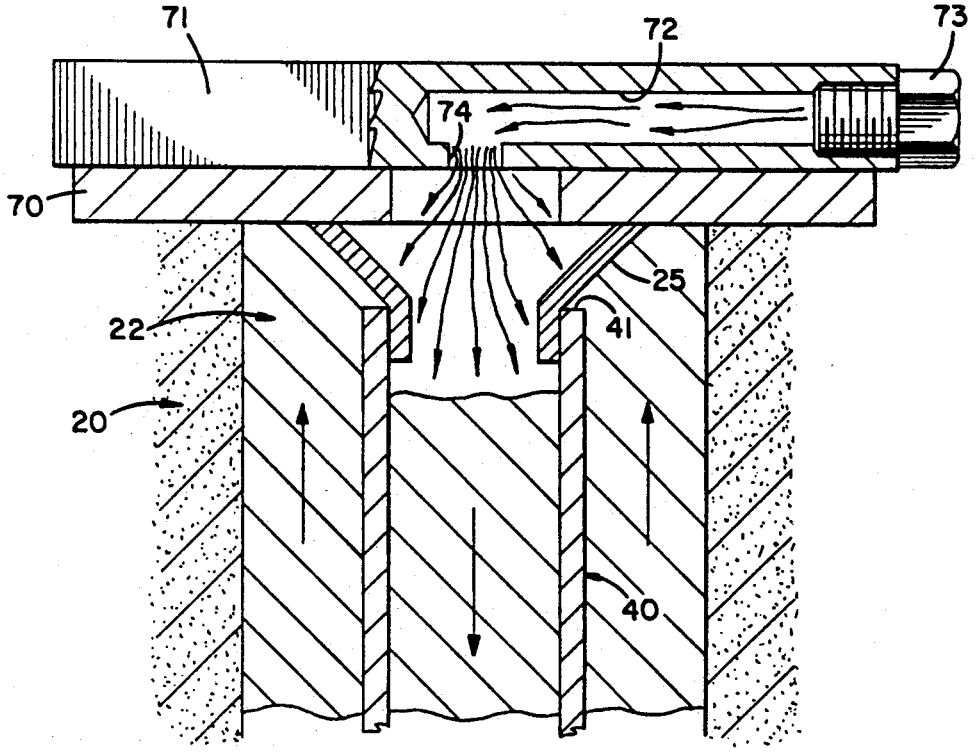
FIG. 12 is a cross-sectional side elevation view, partially broken away, showing a fully assembled investment casting mold or shell and elongated delivery tube of this invention in cooperating interengagement with each other and in use in combination with an external pressurizing source.

As detailed above, although gravity feeding is most often employed in using investment castings, and has been representative of the constructions detailed above, distribution of the molten metal throughout the investment casting mold or shell can be achieved through pressurization of the mold or shell. In FIG. 12, a representative example of a pressurization system is provided.

In this construction, a generally similar construction is employed as discussed above, with mold or shell 20 being constructed in the manner previously detailed with elongated metal delivery conduit 40 being positioned in central sprue 22 of mold or shell 20. In addition, at the proximal end 41 of delivery tube 40, a molten metal pouring cup 25 is positioned for receiving the molten metal for distribution throughout mold or shell 20.

Once the precisely desired amount of molten metal has been poured into cup 25 and tube 40, the open ends of pouring cup 25 and mold or shell 20 are sealed by a gasket or blanket 70 which is placed over the terminating edges thereof. In the preferred embodiment, gasket or blanket 70 is formed from ceramic or silica material, capable of withstanding the heat as well as effectively sealing and closing mold or shell 20.

With gasket or blanket 70 in position, a sealing plate 71 is placed over gasket 70 with the sealing plate incorporating a gas delivery conduit formed therein extending from inlet portal 73 to outlet portal 74. Preferably, sealing plate 71 is formed from steel.

Preferably, liquid argon is connected to inlet 73 and the entire system is exposed to liquid argon at a pressure of between about 2 pounds and 5 pounds. This pressure is maintained until the molten metal has solidified. In this way, the liquid molten metal is dispersed throughout the system by the pressure provided by the liquid argon.

By employing the present invention, generally conventional castings can be used with a minimum of change and a substantially increased benefit to both the overall casting operation as well as the quality and repeatability attained by the casting operation in producing uniformly consistent and structurally sound components. As a result, substantial benefits are derived by employing the present invention, without requiring any substantive changes in the manufacturing technology and techniques presently being used.

It will thus be seen that the objects set forth above, among those made apparent from the preceding description are efficiently attained and, since certain changes may be made in carrying out the above process, as well as in the construction set forth without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

Having described my invention, what I claim as new and desire to secure by Letters Patent is:

1. A molten metal feed system for use in investment castings comprising

A. a mold or shell incorporating a. a central sprue b. a plurality of product-forming cavities, and c. a plurality of juxtaposed, spaced runners or channels extending from the central sprue along the length thereof to the cavities;

B. an elongated, substantially hollow molten metal delivery conduit comprising a. an open proximal end for receiving the molten metal, b. an elongated, molten metal delivery passageway extending substantially the entire length of the conduit, c. positioned in the central sprue in cooperating relationship therewith to form a dual, metal flow-controlling zone; and d. portal means 1. formed adjacent the distal end of the conduit and communicating between the molten metal delivery passageway and the central sprue, 2. establishing the sole molten metal delivery passageway for enabling the molten metal to exit from the conduit, and 3. positioned adjacent or below the lowermost runner or channel of the mold to assure feeding of the molten metal into the central sprue from the bottom thereof; and C. conduit locking means cooperatingly mounted between the central sprue and the molten metal delivery conduit fixedly securely maintaining the delivery tube in the desired position relative to the central sprue, preventing vertical movement of the delivery conduit relative to the central sprue as well as preventing the delivery conduit from being dislodged or displaced during the pouring of the molten metal;

whereby delivery of the molten metal to the product cavities is obtained in an efficient, trouble-free, metered manner, providing the advantages of bottom feeding and the ease of top feeding.

2. The molten metal feed system defined in claim 1, wherein said delivery conduit is further defined as comprising an elongated hollow tube extending substantially the entire length of the central sprue.

3. The molten metal feed system defined in claim 2, wherein said elongated molten metal delivery tube is further defined as e. comprising a substantially cylindrical shape having a diameter smaller than the diameter of the central sprue, and f. being coaxially aligned with the central sprue to form two, concentrically aligned metal flow transfer zones.

4. The molten metal feed system defined in claim 3, wherein said molten metal delivery conduit is further defined as comprising a plurality of portals formed adjacent the distal end thereof for providing controlled metal flow from the inside of the conduit to the outside thereof, enabling the molten metal to be controllably delivered from the molten metal delivery conduit to the central sprue, starting at the bottom thereof, establishing a dual, concentrically arranged flow pattern, whereby molten metal flows down the conduit, into the bottom of the central sprue and then up the central sprue and into the passageways and cavities.

5. The molten metal feed system defined in claim 1, further comprising

D. an annular zone a. formed in the investment casting shell or mold at the base of the central sprue, b. comprising a diameter greater than the diameter of the central sprue, and c. radially extending in coaxial alignment with the central sprue; and the molten metal delivery conduit is further defined as comprising an open distal end positioned in juxtaposed, spaced cooperating relationship with the annular zone, whereby metal poured into the proximal end of the delivery conduit initially exits through the distal end, into the annular zone.

6. The molten metal feed system defined in claim 5, wherein said annular zone is further defined as comprising a bottom surface incorporating a convexly shaped portion, centrally disposed thereon and positioned substantially coaxially with the molten metal delivery conduit, thereby assisting in the channeling of the molten metal into the annular zone.

7. The molten metal feed system defined in claim 1, further comprising

D. a supporting flange a. positioned in the central sprue of the investment casting shell or mold, adjacent the base thereof, and b. radially extending inwardly from the sprue-defining wall, terminating with a slanted or tapered surface; and E. a conduit positioning ring dimensioned for mating, supported interengagement with the radially extending supporting flange and comprising a. an outer edge surface comprising an angular, slanted construction for mating locking interengagement with the slanted surface of the flange, and b. an inside surface constructed for mating interengagement with the outer surface of the molten metal delivery conduit, whereby the delivery conduit is supportingly positioned and retained by the ring in the desired location.

8. The molten metal feed system defined in claim 7, wherein the inside surface of the ring is further defined as comprising a size and shape conforming to the size and shape of the delivery conduit, providing cooperative, sliding interengagement of the ring with the molten metal delivery conduit.

9. The molten metal feed system defined in claim 1, wherein the conduit locking means is further defined as comprising a. a plurality of posts radially extending from the surface of the central sprue, and b. a locking member 1. constructed for peripheral surrounded mounted engagement with the outer surface of the delivery conduit, and 2. comprising locking arms constructed for cooperative, movable locking engagement with the radially extending posts, thereby securely lockingly positioning and holding the conduit in the desired position relative to the central sprue whenever desired.

10. The molten metal feed system defined in claim 9, wherein the locking member is further defined as an enlarged ring having an inside surface constructed for cooperating mounted engagement to the delivery conduit and an outside surface incorporating a plurality of radially extending, post-engaging ramps positioned for sliding, locking interengagement with the posts of the central sprue.

11. A method for feeding molten metal into an investment casting shell or mold comprising the steps of A. forming an investment casting shell or mold incorporating a central sprue, a plurality of runners or channels and a plurality of product-forming cavities;

B. telescopically inserting an elongated, open-ended, substantially hollow delivery conduit into the central sprue, extending substantially to the base of the sprue with the elongated conduit comprising at least one portal a. formed adjacent the distal end of the conduit and communicating between the molten metal delivery passageway and the central sprue, b. establishing the sole molten metal delivery passageway for enabling the molten metal to exit from the conduit, and c. positioned adjacent or below the lowermost runner or channel of the mold to assure feeding of the molten metal into the central sprue from the bottom thereof; and C. lockingly engaging the delivery conduit in the central sprue to prevent vertical movement of the delivery conduit relative to the central sprue as the molten metal fills the sprue; and D. filling the investment casting mold or shell with molten metal by pouring the molten metal into the delivery conduit, causing the metal to flow through the conduit before entering the base of the central sprue for distribution to the runners and the product-forming cavities commencing with the bottom of the central sprue after filling the central sprue, whereby controlled, pressurized bottom to top feeding of non-turbulent, molten metal into the product-forming cavities is achieved with high quality products being produced.

12. The method defined in claim 11, comprising the additional step of

F. anchoring the distal end of the delivery conduit adjacent the base of the central sprue, thereby assuring the secure placement of the delivery tube in the desired position.

13. The method defined in claim 11, comprising the additional step of

E. forming the delivery conduit with a thickness constructed to provide the required quantity of molten metal to the investment casting shell or mold while also minimizing any additional molten metal, whereby cost savings are realized by reducing the use of unnecessary molten metal.

14. A molten metal feed system for use in investment castings comprising

A. a mold or shell incorporating a. a central sprue b. a plurality of product-forming cavities, and c. a plurality of runners or channels extending from the central sprue to the cavities;

B. an elongated, substantially hollow, molten metal delivery conduit comprising a. an open proximal end for receiving the molten metal, b. an elongated, molten metal delivery passageway extending substantially the entire length of the conduit, c. at least one portal 1. formed adjacent the distal end of the conduit and communicating between the molten metal delivery passageway and the central sprue, 2. establishing the sole molten metal delivery passageway for enabling the molten metal to exit from the conduit, and
3. positioned adjacent or below the lowermost runner or channel of the mold to assure feeding of the molten metal into the central sprue from the bottom thereof; and d. positioned in the central sprue in cooperating relationship therewith to form a dual, metal flow-controlling zone;
e. a substantially cylindrical shape having a diameter smaller than the diameter of the central sprue, and
f. coaxially aligned with the central sprue to form two, concentrically aligned metal flow transfer zones;

C. conduit locking means cooperatingly mounted between the central sprue and the molten metal delivery conduit to securely maintain the delivery tube in the desired position relative to the central sprue, preventing the delivery conduit from being dislodged or displaced during the pouring of the molten metal and comprising
a. a plurality of posts radially extending from the surface of the central sprue, and
b. a locking member
1. constructed for peripheral surrounded mounted engagement with the outer surface of the delivery conduit, and
2. comprising locking arms constructed for cooperative, movable locking engagement with the radially extending posts, D. a supporting flange
a. positioned in the central sprue of the investment casting shell or mold, adjacent the base thereof, and
b. radially extending inwardly from the sprue-defining wall, terminating with a slanted or tapered surface; and E. a conduit positioning ring dimensioned for mating, supported interengagement with the radially extending supporting flange and comprising
a. an outer edge surface comprising an angular, slanted construction for mating locking interengagement with the slanted surface of the flange; and
b. an inside surface comprising a size and shape conforming to the size and shape of the delivery conduit, providing cooperative, sliding, mating interengagement of the ring with the outer surface of the molten metal delivery conduit, whereby delivery of the molten metal to the product cavities is obtained in an efficient, trouble-free, metered manner, providing the advantages of bottom feeding and the ease of top feeding.

15. The molten metal feed system defined in claim 14, wherein said molten metal delivery conduit is further defined as comprising a plurality of portals formed adjacent the distal end thereof for providing controlled metal flow from the inside of the conduit to the outside thereof, enabling the molten metal to be controllably delivered from the molten metal delivery conduit to the central sprue, starting at the bottom thereof, establishing a dual, concentrically arranged flow pattern, whereby molten metal flows down the conduit, into the bottom of the central sprue and then up the central sprue and into the passageways and cavities.

16. The molten metal feed system defined in claim 14, further comprising F. an annular zone
a. formed in the investment casting shell or mold at the base of the central sprue,
b. comprising a diameter greater than the diameter of the central sprue, and
c. radially extending in coaxial alignment with the central sprue; and the molten metal delivery conduit is further defined as comprising an open distal end positioned in juxtaposed, spaced cooperating relationship with the annular zone, whereby metal poured into the proximal end of the delivery conduit initially exits through the distal end, into the annular zone.

17. The molten metal feed system defined in claim 16, wherein said annular zone is further defined as comprising a bottom surface incorporating a convexly shaped portion, centrally disposed thereon and positioned substantially coaxially with the molten metal delivery conduit, thereby assisting in the channeling of the molten metal into the annular zone.

18. The molten metal feed system defined in claim 14, wherein the locking member is further defined as an enlarged ring having an inside surface constructed for cooperating mounted engagement to the delivery conduit and an outside surface incorporating a plurality of radially extending, post-engaging ramps positioned for sliding, locking interengagement with the posts of the central sprue.

* * * * *